US010830042B2

(12) United States Patent
Parrott

(10) Patent No.: US 10,830,042 B2
(45) Date of Patent: Nov. 10, 2020

(54) CUTTER PICK ASSEMBLY WITH WATER SPRAY ASSEMBLY

(71) Applicant: Minnovation Limited, West Yorkshire (GB)

(72) Inventor: George Albert Parrott, Wakefield (GB)

(73) Assignee: Minnovation Limited, West Yorkshire (GB)

( * ) Notice: Subject to any disclaimer, the term of this patent is extended or adjusted under 35 U.S.C. 154(b) by 30 days.

(21) Appl. No.: 16/332,465

(22) PCT Filed: Sep. 18, 2017

(86) PCT No.: PCT/EP2017/073520
§ 371 (c)(1),
(2) Date: Mar. 12, 2019

(87) PCT Pub. No.: WO2018/050900
PCT Pub. Date: Mar. 22, 2018

(65) Prior Publication Data

US 2020/0208516 A1 Jul. 2, 2020

Related U.S. Application Data

(60) Provisional application No. 62/396,586, filed on Sep. 19, 2016.

(51) Int. Cl.
*E21C 35/187* (2006.01)
*E21C 35/22* (2006.01)
(Continued)

(52) U.S. Cl.
CPC ..... *E21C 35/187* (2013.01); *E21C 35/197* (2013.01); *E21C 35/22* (2013.01);
(Continued)

(58) Field of Classification Search
CPC ..... E21C 35/186; E21C 35/187; E21C 35/22; E21C 25/60; E21C 35/23; E01C 2301/50; B28D 7/02
See application file for complete search history.

(56) References Cited

U.S. PATENT DOCUMENTS 4,657,308 A 4/1987 Clapham
6,485,104 B1 11/2002 Keller
(Continued)

FOREIGN PATENT DOCUMENTS

| | | | | |
|---|---|---|---|---|
| CN | 201026477 Y | 2/2008 | | |
| DE | 3205315 A1 | 7/1983 | | |
| DE | 3334031 A1 * | 4/1985 | ..... | E21C 35/1833 |
| EP | 0587991 A2 | 3/1994 | | |

OTHER PUBLICATIONS

English language machine translation of Honke, German patent publication DE-3202315-A, published Jul. 28, 1983 (2 pages) (Year : 1983).*

(Continued)

*Primary Examiner* — David J Bagnell
*Assistant Examiner* — Michael A Goodwin
(74) *Attorney, Agent, or Firm* — Hooker & Habib, P.C.

(57) ABSTRACT

A cutter bit assembly for use in underground mining, road grading, and the like includes a water spray assembly having a water nozzle in a first chamber that discharges a water spray through an air gap and into the open end of a second chamber facing the air gap. Air is drawn into the water spray entering the second chamber from the air gap to produce a finer spray that is discharged from a second open end of the second chamber. The water spray helps clear the second chamber of any dirt or debris drawn by the air into the second chamber.

15 Claims, 3 Drawing Sheets

(51) Int. Cl.

| | |
|---|---|
| ***E21C 35/197*** | (2006.01) |
| *E21C 35/18* | (2006.01) |
| *E21C 35/183* | (2006.01) |
| *E21C 35/23* | (2006.01) |

(52) U.S. Cl.
CPC ..... *E01C 2301/50* (2013.01); *E21C 35/183* (2013.01); *E21C 35/188* (2020.05); *E21C 35/1837* (2020.05); *E21C 35/23* (2013.01)

(56) References Cited

U.S. PATENT DOCUMENTS

| | | | | |
|---|---|---|---|---|
| 2011/0006587 | A1* | 1/2011 | Parrott | E21C 35/187 299/81.3 |
| 2014/0312678 | A1* | 10/2014 | Parrott | E21C 35/19 299/81.3 |
| 2016/0341040 | A1* | 11/2016 | Weber | E21C 35/187 |

OTHER PUBLICATIONS

English language machine translation of Schiel et al., EPO publication EP-0587991-A, published May 5, 1993 (2 pages) (Year: 1993).*

European Patent Office, International Search Report and Written Opinion in corresponding PCT/EP2017/073520, dated Dec. 6, 2017, 15 pages.

F. Lemmes Meisselhalter Mit Ejektor-Scheidspurbeduesung, Gluckauf, Minova Carbo Tech GmbH, Dec. 10, 1998, vol. 134, No. 12, ISSN 0340-7896, pp. 680-684, Essen, Germany.

China National Intellectual Property Administration, Office action in corresponding Chinese Application 201780057298, dated Jul. 20, 2020, 15 pages.

European Patent Office, English language machine translation of CN201026477Y, 3 pages.

* cited by examiner

CUTTER PICK ASSEMBLY WITH WATER SPRAY ASSEMBLY

FIELD OF THE DISCLOSURE

The disclosure relates generally to a cutter pick assembly for mineral and rock cutting having a water spray assembly, and in particular, to a cutter pick assembly having a pick box and a cutter bit mounted in the pick box, the water spray assembly spraying water on or near the cutter bit during use.

BACKGROUND OF THE DISCLOSURE

A conventional rotary cutting tool used for coal mining, road grading, and the like includes a number of cutter pick assemblies mounted on the outer cylindrical surface of a drum. Each cutter pick assembly includes a pick box welded to the outer surface of the drum that removably receives a cutter pick carrying a carbide cutter tip. The cutter pick is mounted in a bore formed in the pick box. Examples of cutter tool assemblies are shown in U.S. Pat. Nos. 8,661,640 and 8,579,380, each incorporated by reference as if fully set forth herein.

Cutter pick assemblies used for coal mining are provided with water spray assemblies that spray water onto the cutter pick with a view to elimination of so-called incendive sparking. A water spray assembly includes a spray nozzle mounted in the pick box that discharges a conical water spray towards the cutter bit. It is also desirable that air be drawn into the water spray to form fine water droplets in the water spray.

In some applications, it is desirable that the water spray completely overlap the cutter tip. Keller U.S. Pat. No. 6,485,104 discloses a water spray assembly for a cutter pick assembly in which a spray nozzle is mounted in a spray nozzle housing mounted on the outside of the pick box. The spray nozzle discharges water at an angle $\alpha$ of 14 degrees with respect to the longitudinal axis of the pick box bore to direct the water spray towards the cutter bit. However, there is little, if any, air drawn into the water spray.

Krummenauer GmbH EP 0587991 B1 discloses a water spray assembly for a cutter pick assembly that draws air into the water spray. The spray nozzle is mounted in a tubular recess formed in the spray nozzle housing. The discharge end of the spray nozzle is spaced inwardly from an open end of the recess. Air inlets formed as bores in the spray nozzle housing open into the recess near the discharge end of the spray nozzle. The air inlet openings, however, have a tendency to draw solid particulates into the openings that clog the air inlets or otherwise impede or obstruct air flow into the recess.

Clapham U.S. Pat. No. 4,657,308 discloses a cutter pick assembly having a water nozzle that passes water through a bore carried by a shoulder formed on the cutter pick and extending away from one side of the cutter pick. The entrance end of the bore is spaced from the water nozzle by an air gap. The shoulder increases the size of the cutter pick and requires the cutter pick to remain stationary with respect to the pick box during use.

Thus it is desirable to provide a cutter pick assembly having a water spray assembly that discharges a water spray that overlaps the cutter tip and draws air into the water spray to form fine water droplets in the water spray while reducing the tendency to impede or obstruct air flow into the water spray without increasing the size of the cutter pick and without requiring the cutter pick to remain stationary with respect to the pick box.

SUMMARY OF THE DISCLOSURE

Disclosed is a cutter pick assembly having a water spray assembly that discharges a water spray that overlaps or nearly overlaps the cutter tip and draws air into the water spray to form fine water drops in the water spray that also reduces the tendency to impede or obstruct air flow into the water spray.

The disclosed cutter bit assembly includes a pick box, a cutter bit carrying a cutter tip, and a water spray assembly attached to the pick box, the water spray assembly made up of a first chamber, and a second chamber. The first chamber has a chamber wall defining an open first end of the first chamber and the second chamber has opposite open first and second ends, with the open end of the first chamber and the open first end of the second chamber facing and being spaced apart by an air gap open to the ambient atmosphere.

The water nozzle includes a discharge end, a water inlet, and a seal disposed between the discharge end and the water inlet. The water nozzle is disposed in the first chamber with the discharge end of the water nozzle aiming at the open first end of the second chamber. The water inlet is aligned with an opening in the first chamber wall that is connectable to a water source during cutting operations. The seal engages the first chamber wall and sealingly divides the first chamber between the water inlet and the discharge end of the spray, The wall of the first chamber extends without openings from the water nozzle seal to the open end of the first chamber.

The water spray discharged from the nozzle enters the open first end of the second chamber and is discharged from the open second end of the second chamber. The water spray entering the open first end of the second chamber induces an air flow into the second chamber from the air gap. The induced air flow is entrained with the water spray as the water spray flows through the second chamber. The water spray is discharged from the open second end of the second chamber with fine water droplets that flow to or near the cutter bit. The second chamber may expand in the downstream direction as it extends towards the second end of the second chamber.

In an embodiment, the air gap is the sole source for ambient air drawn into the water spray initially discharged by the water nozzle. The discharge end of the water spray is disposed in the air gap, and the portion of the first chamber adjacent the open end of the first chamber is sealed from the ambient air.

In another possible embodiment, the first chamber is formed as a through-bore in a first housing and the second chamber is formed as a through-bore in a second housing, each housing extending away from an outer surface of the pick box and spaced apart by the air gap. The first and second housings may extend radially outwardly from the center of rotation of the drum past the remainder of the pick box when the pick box is attached to the drum.

One or both of the housings of the water spray assembly may be integrally formed with the pick box, that is, formed from the same block of material forming the pick box. In yet other possible embodiments the first and second housings may be formed as a one piece member having a connecting member that joins the housings and faces the air gap defined between the housings. In yet other embodiments the first and second housings may be formed by machining the air gap in a body to form the two spaced apart housing.

In yet another possible embodiment of the water spray assembly, the water spray discharged from the water nozzle enters the second chamber with clearance between itself and a wall defining the first opening of the second chamber. The clearance better enables the ambient air drawn from the air gap into the second chamber to be entrained with the water spray.

The second chamber may have a non-circular cross-section, with a radially lower portion that is radially inside of the remainder of the pick box. The radially lower portion may be defined by the outer surface of the pick box and may be formed as a depression formed at the outer surface of the pick box that partially surrounds the through-bore. The depression enables the water spray discharged from the through-bore to be better directed towards the cutter bit.

In a possible variant embodiment, the shape of the water spray cross-section when the water spray is discharged from the second chamber may be generally "D" shaped, with the radially lower portion of the spray having a generally flat outer perimeter. The flat outer perimeter may be defined by the outer surface of the pick box. The curved portion of the "D" may be defined by a wall defining at least part of the second chamber. The second chamber may also have a conical section that expands in the downstream direction towards the second end of the chamber.

In a further possible variant embodiment, the outer surface of the pick box immediately downstream from the second end of the second chamber may include a depression that extends in the downstream direction from the second chamber and conforms to the depression surrounding part of the second chamber.

In yet additional possible embodiments, the cutter pick is removably mounted in a sleeve that in turn is received in a cutter pick bore. The sleeve may have an enlarged head that locates the sleeve against a surface of the pick box. The head may have a depressed outer that aligns and conforms with an adjacent depression formed on the outer surface of the pick box.

The disclosed water spray assembly has a number of advantages. Because the water spray assembly is attached to the pick box, the cutter pick does not require a shoulder or other structure to receive the water spray and so the size of the cutter pick can be minimized. The cutter pick in embodiments may be of the type that rotates about an internal axis during use for even wear of the bit. The chambers being on the pick box moves the chambers farther from the cutter bit and reduces the likelihood of clogging.

Other objects and features of the disclosure will become apparent as the description proceeds, especially when taken in conjunction with the accompanying drawing sheets illustrating one or more illustrative embodiments.

DETAILED DESCRIPTION

Figure 1:
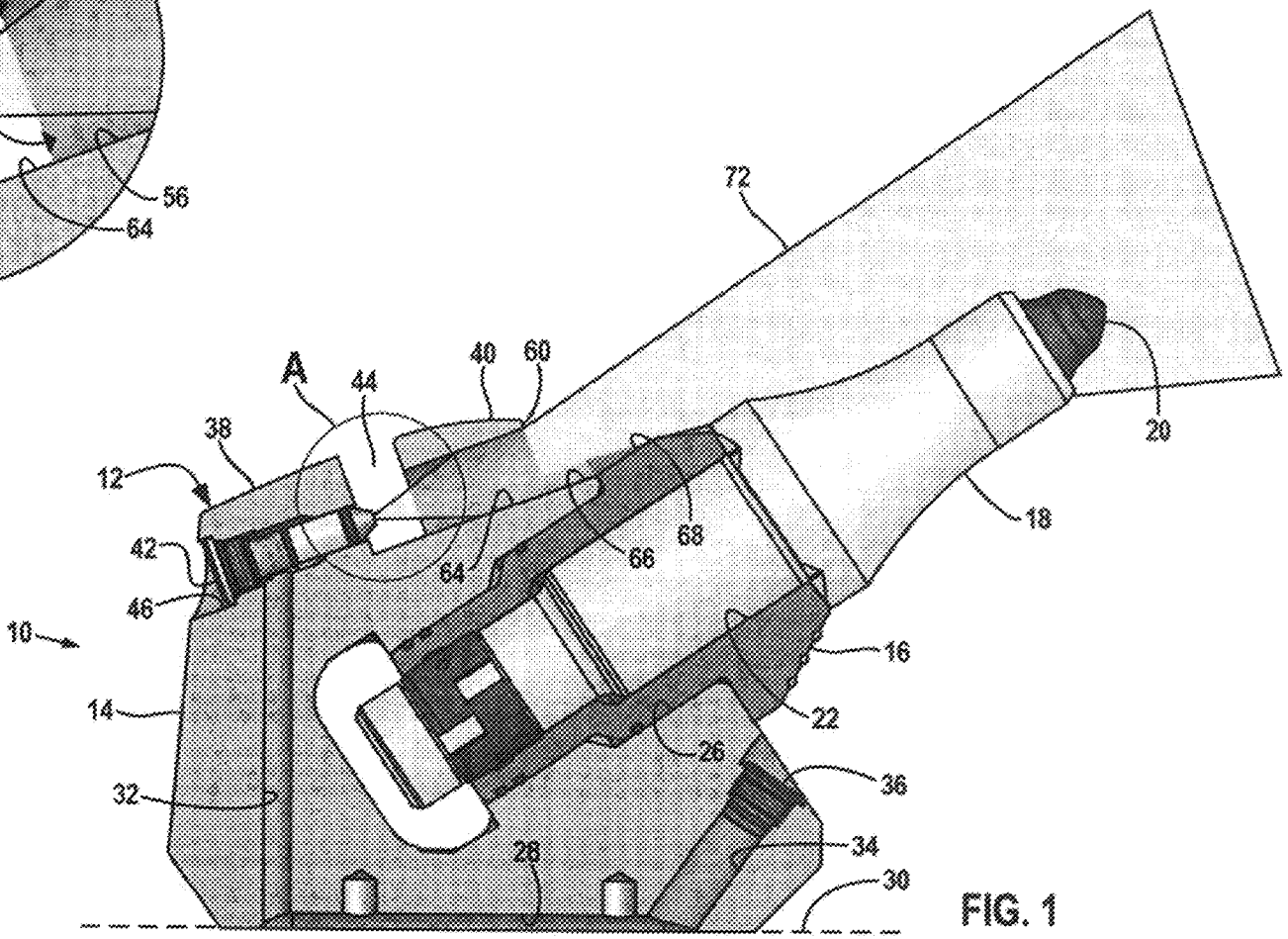
FIG. 1 is a vertical section view of a cutter pick assembly in accordance with the disclosure and illustrating the water spray pattern discharged from the cutter pick assembly.

The figures disclose an embodiment of a cutter pick assembly 10 in accordance with this disclosure that includes a water spray assembly 12.

The cutter pick assembly 10 includes a block or pick box 14, a sleeve 16, and a cutter pick 18 that carries a carbide cutter tip 20. The cutter pick 18 is removably mounted in a pick bore 22 of the sleeve 14, and the sleeve 14 is removably mounted in a sleeve bore 26 of the pick box in a conventional manner.

The pick box 14 has a base 28 that mounts the pick box 14 to the outer surface of a drum 30 (the drum outer surface being shown in part by broken lines). Internal water channels 32, 34 flow water received from the drum to the water spray assembly 12 and to a spray blank 36 in a conventional manner.

The water spray assembly 12 is mounted on the outside of the pick box 14 and includes a first housing 38, a second housing 40 spaced from the first housing, and a spray nozzle 42 carried in the first housing. An air gap 44 open to the ambient air separates the first and second housings. The housings 38, 40 in the illustrated embodiment are formed as part of the pick box 14.

The first housing 38 has a through-hole 46 having an enlarged threaded end portion at one end and a reduced diameter portion at the other end opening into the air gap 44. The wall of the through-hole 46 is solid and unbroken except where the water channel 32 opens into the through-hole at an intermediate portion of the through-hole.

The spray nozzle 42 has a threaded attachment end 48 and a discharge end 50. The spray nozzle is inserted into the enlarged end of the through-hole 46 and is screwed into the first housing 38 to attach the spray nozzle to the first housing and close the one end of the through-hole 46. The water channel 32 opens into the through-hole between sets of nozzle O-ring seals 52, 54. The discharge end of the spray nozzle is located in the air gap 44 a short distance from the first housing and is aligned to discharge a water spray from the nozzle into the air gap 44 and towards the second housing 40.

The second housing 40 includes a through-bore 56 that extends in an axial direction away from an upstream end 58 of the second opening facing the air gap 44 and a downstream end 60 facing the cutter pick 18. In the illustrated embodiment a first circumferential portion of the through-bore 56 is defined by a wall of the second housing 40 that partially surrounds the through-bore 56 that cooperates with an outer surface of the pick box 14 that defines the remaining circumferential portion of the through-bore 56. In other possible embodiments the wall of the second housing 40 surrounds the entire through-bore 56.

The through-bore 56 extends from the upstream end 58 to the downstream end 60 without any breaks or openings in the wall surrounding the through-bore.

The pick box 14 has a cylindrical outer surface 62 of substantially constant diameter extending along the sleeve bore 26. The through-bore 56 is partially defined by an outer pick box surface 64 facing the air gap 44 and extending to the discharge end of the second housing. The outer surface 64 is formed as a recess or depression in the outer surface 62 as can best be seen in FIGS. 1, 4, and 5. The portion 66 of the recessed pick box surface 64 extending from the downstream end 60 of the second housing to the open end of the sleeve bore 26 cooperates with the through-bore 56 to provide a smooth, obstruction-free discharge path for the spray discharged from the second housing 40.

In the illustrated embodiment the enlarged head 22 of the sleeve 16 includes a sloping slot or recess surface 68 that, when the sleeve is mounted in the sleeve bore 26, is aligned with the pick box recessed surface 64 to continue to provide a smooth, obstruction-free discharge path past the sleeve for the spray being discharged from the second housing 40. The sleeve surface 68 also assists in defining the outer shape of the water spray.

Figure 5:
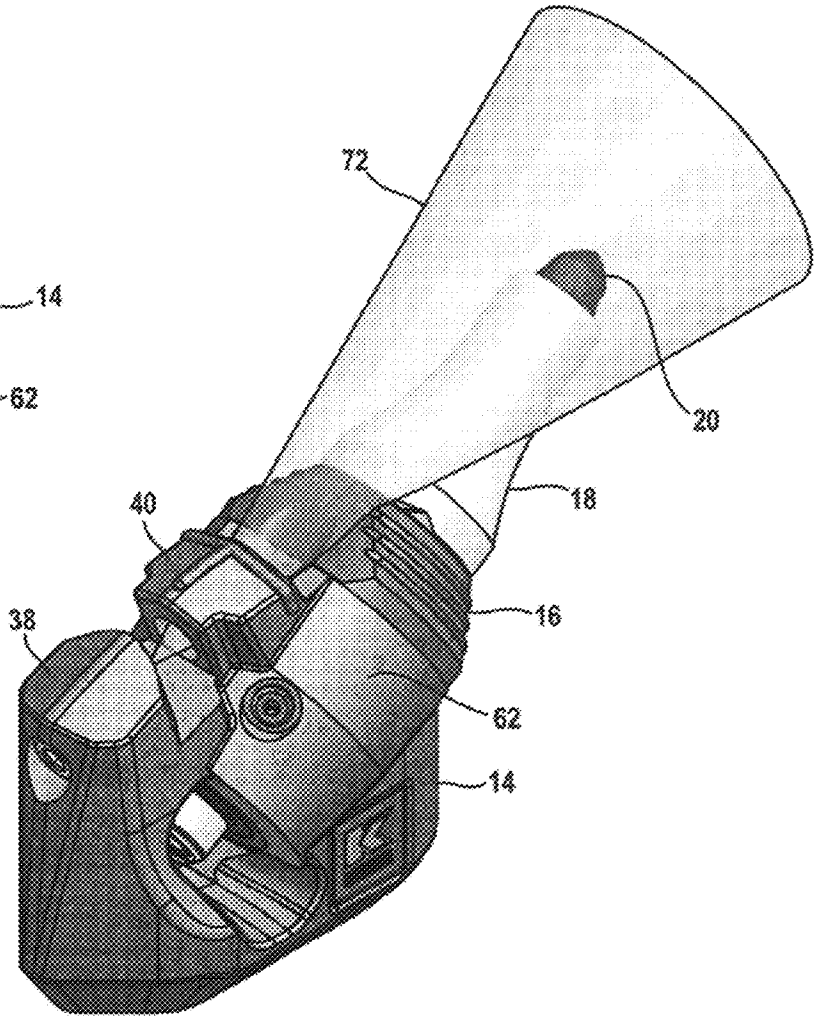
FIG. 5 is similar to FIG. 4 but is a rear-right perspective view.
Figure 4:
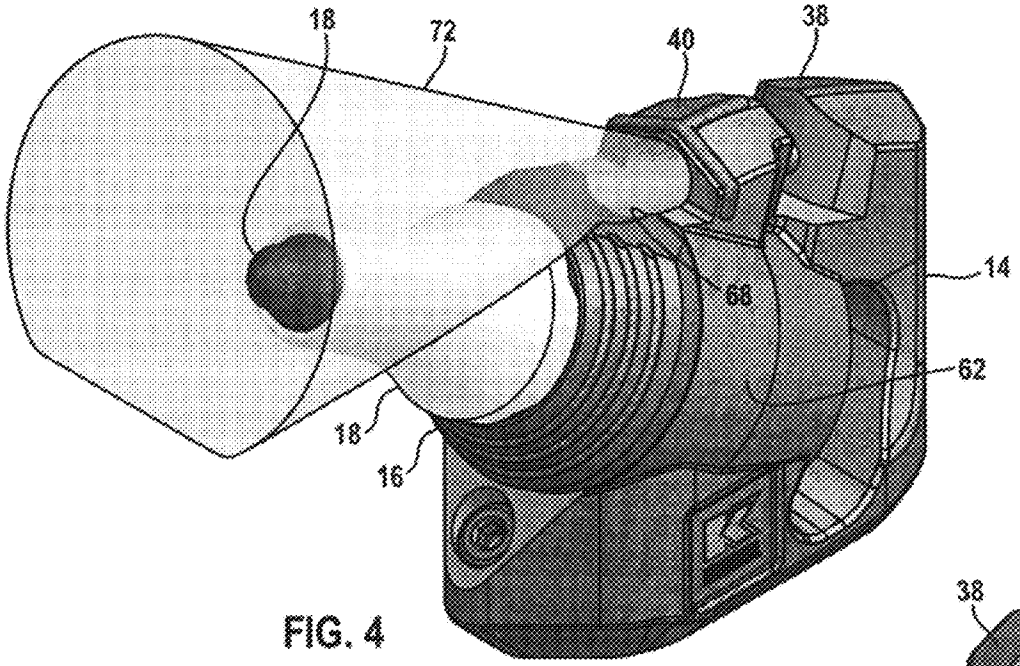
FIG. 4 is a front-left perspective view of the cutter pick assembly of FIG. 1 illustrating the water spray pattern discharged from the cutter pick assembly.

FIGS. 1, 4, and 5 illustrate the water spray assembly in use and discharging a generally conical water spray towards and overlapping the cutter tip 20.

Figure 2:
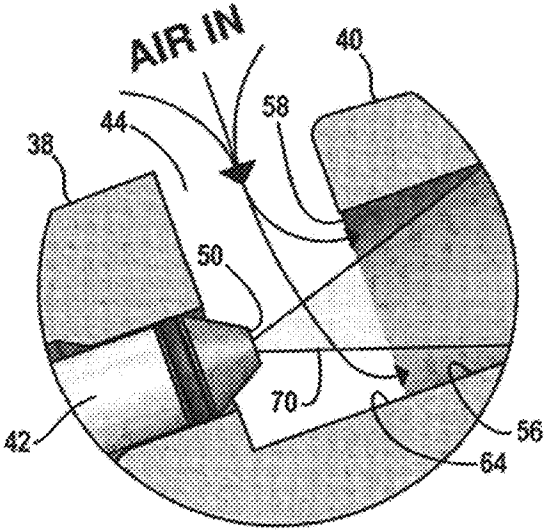
FIG. 2 is an enlarged view of Area A of FIG. 1.
Figure 3:
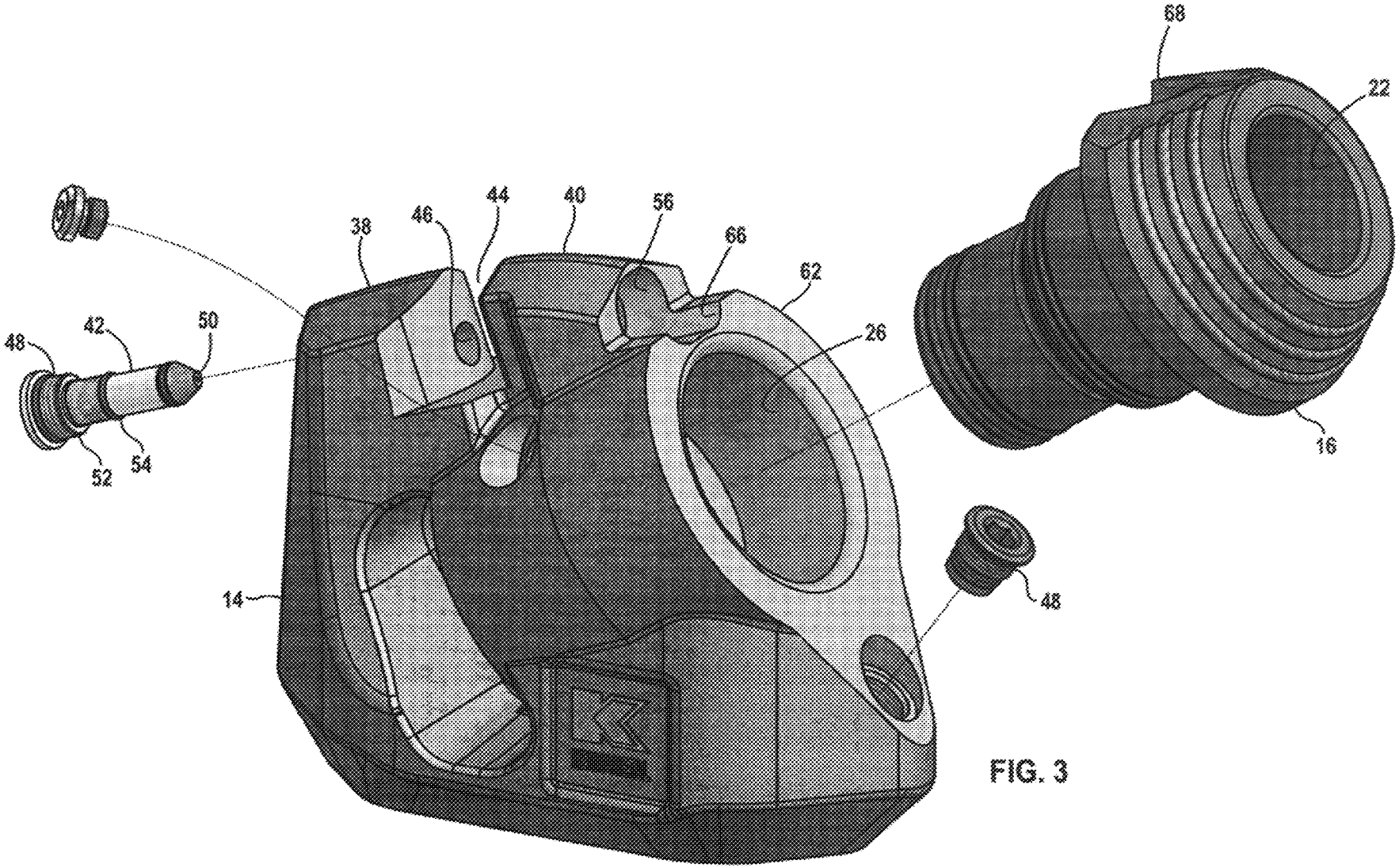
FIG. 3 is an exploded view of the cutter pick assembly of FIG. 1 (the cutter pick carrying the cutter bit is omitted).

The spray nozzle 42 is aligned by the through-hole 46 of the first housing 38 to discharge a conical water spray 70 (best seen in FIG. 2) into the air gap 44 and into the upstream end 58 of the through-bore 56 of the second housing. The water spray 70 is sized to be received at the through-bore 56 with an initial clearance between the water spray and the wall defining the through-bore. The clearance assists in the water spray inducing air flow into the air gap and into the through-bore (as illustrated in FIG. 2) and mixing the drawn-in air with the water of the water spray entering the through-bore.

The through-bore 56 discharges the water spray as a generally conical spray 72 that will overlap the cutter tip 20 as seen in FIGS. 1, 4, and 5. The illustrated through-bore has a non-circular cross section shaped generally as a truncated, axially offset oval that is wider at the bottom portion of the through-bore 56 adjacent the pick box 14. The cross-section of the conical water spray 72 after passing the sleeve 16 is generally "D" shaped as best seen in FIG. 4 to optimize the spray pattern at the cutter bit.

In other embodiments the water spray assembly 12 may be modified such that the water spray 72 is positioned near to, but does not overlap, the cutter tip 20.

Air flow induced into the air gap 44 and the through-bore may also carry along dirt, particulates, and like contaminants generated during the mining/cutting process. Because the air gap 44 is open at three sides, contaminants drawn into the air gap can move out of the air gap and do not necessarily have to stay in the air gap. The water spray 70 washes contaminants out of the through-bore 56, providing a continuous cleaning action that resists clogging of the air gap 44 and the through-bore 56 for more dependable operation of the water spray assembly.

While one or more embodiments have been disclosed and described in detail, it is understood that this is capable of modification. For example (and not intended to be limiting), the shape of the through=bore 56 and the inclination of the longitudinal axis of the spray nozzle housing can vary from that shown. Other types of spray nozzle designs can be adapted for use herein. The scope of the disclosure is not limited to the precise details set forth but includes modifications obvious to a person of ordinary skill in possession of this disclosure and the claims.

The invention claimed is:

1. A cutter bit assembly for use in cutting operations for underground mining, road grading, and the like comprising:

a pick box, a cutter bit carrying a cutter tip, and a water spray assembly attached to the pick box, the water spray assembly comprising a water nozzle, a first chamber, and a second chamber;

the first and second chambers being disposed on an outer surface of the pick box and being spaced apart from one another along the outer surface, the first chamber comprising a wall defining an open first end of the first chamber, the second chamber having opposite first and second open ends, the first end of the first chamber and the first end of the second chamber facing one another and being spaced apart from one another by an air gap extending uninterruptedly along said outer surface of the pick box from the first end of the first chamber to the first end of the second chamber, the air gap being open to the ambient atmosphere and extending away from the outer surface of the pickbox wherein the entire first open ends of the first and second chambers face and define opposite ends of the airgap;

the water nozzle comprising a discharge end, a water inlet, and a seal disposed between the discharge end and the water inlet, the water nozzle being disposed in the first chamber with the discharge end of the water nozzle aiming at the first end of the second chamber, the water inlet being aligned with an opening in the first chamber wall that receives water into the first chamber during cutting operations, and the seal engaging the first chamber wall and sealingly dividing the first chamber between the water inlet and the discharge end of the water nozzle; and the first chamber wall extending without openings from the water nozzle seal to the first end of the first chamber.

2. The cutter bit assembly of claim 1 wherein the water nozzle extends out from the first end of the first chamber, the discharge end of the water nozzle being in the air gap.

3. The cutter bit assembly of claim 1 wherein the water nozzle closes an open second end of the first chamber.

4. The cutter bit assembly of claim 1 wherein the water nozzle discharges a water spray that enters the first open end of the second chamber with clearance between at least a portion of the water spray and a wall surrounding the first end of the second chamber.

5. The cutter bit assembly of claim 1 wherein the water spray assembly comprises a first housing and a second housing on opposite sides of the air gap, each housing on an outer surface of the pick box, the first chamber being formed as a bore in the first housing and the second chamber being at least partially disposed in the second housing.

6. The cutter bit assembly of claim 5 wherein the second housing partially surrounds a circumferential portion of the second chamber and a portion of the outer surface of the pick box surrounds a remaining circumferential portion of the second chamber.

7. The cutter bit assembly of claim 6 wherein the portion of the outer surface of the pick box is a depressed outer surface of the pick box.

8. The cutter bit assembly of claim 7 wherein the depressed outer surface of the pick box extends to beneath the air gap.

9. The cutter bit assembly of claim 5 wherein the outer surface of the pick box faces the air gap.

10. The cutter bit assembly of claim 5 wherein each housing has a face facing the air gap, the air gap being unobstructed between the housing faces.

11. The cutter bit assembly of claim 5 wherein the first and second housings are integrally formed with the pick box.

12. The cutter bit assembly of claim 1 wherein the second chamber has a non-circular cross-section.

13. The cutter bit assembly of claim 1 wherein the pick box has a depressed outer surface extending away from the second end of the second chamber.

14. The cutter bit assembly of claim 13 wherein the cutter bit assembly comprises a sleeve mounted in a bore of the pick box that carries the cutter bit, the sleeve comprising a depressed outer surface, the sleeve can be aligned with respect to the pick box wherein the depressed outer surface of the sleeve is aligned with and conforms with the depressed outer surface of the pick box.

15. The cutter bit assembly of claim 1 wherein the cutter bit is capable of rotating about an internal axis of the cutter bit during cutting operations.

* * * * *